US012722864B2

(12) United States Patent
Laganis

(10) Patent No.: US 12,722,864 B2
(45) Date of Patent: Sep. 1, 2026

(54) MOISTURE RETAINING CONTAINER SYSTEMS

(71) Applicant: TANGLED BRANDS INC., Brooklyn, NY (US)

(72) Inventor: Edward Laganis, Hoboken, NJ (US)

(73) Assignee: TANGLED BRANDS INC., Brooklyn, NY (US)

( * ) Notice: Subject to any disclaimer, the term of this patent is extended or adjusted under 35 U.S.C. 154(b) by 0 days.

(21) Appl. No.: 19/176,092

(22) Filed: Apr. 10, 2025

(65) Prior Publication Data

US 2025/0320049 A1 Oct. 16, 2025

Related U.S. Application Data

(60) Provisional application No. 63/632,402, filed on Apr. 10, 2024.

(51) Int. Cl.

| | |
|---|---|
| ***B65D 77/04*** | (2006.01) |
| ***B65D 43/16*** | (2006.01) |
| ***B65D 65/46*** | (2006.01) |
| ***B65D 83/08*** | (2006.01) |

(52) U.S. Cl.

CPC ..... *B65D 77/0486* (2013.01); *B65D 43/169* (2013.01); *B65D 65/466* (2013.01); *B65D 83/08* (2013.01)

(58) Field of Classification Search

CPC ..... A47K 10/3818; A47K 10/421; A47K 2010/3266; B65D 77/0486; B65D 65/466; B65D 83/08; B65D 83/0805; B65D 77/06

USPC .... 206/494, 409, 389, 812; 221/63, 303, 45; 220/254.3, 495.05

See application file for complete search history.

(56) References Cited

U.S. PATENT DOCUMENTS

| | | | | | |
|---|---|---|---|---|---|
| 4,219,129 | A * | 8/1980 | Sedgwick | A47K 10/3818 | 118/43 |
| 4,651,895 | A * | 3/1987 | Niske | A47K 10/421 | 221/63 |
| 5,803,300 | A * | 9/1998 | DeMars | B65F 1/1468 | 220/495.11 |
| 6,158,614 | A * | 12/2000 | Haines | A47K 10/3818 | 221/33 |
| 6,182,858 | B1 * | 2/2001 | Hartog | A47K 10/3818 | 221/63 |

(Continued)

*Primary Examiner* — Steven A. Reynolds
(74) *Attorney, Agent, or Firm* — Mertzlufft Law PLLC; Joshua Mertzlufft

(57) ABSTRACT

The container system includes a cylindrical canister with a base and a sidewall featuring multiple through-holes, and a removable liner positioned within the canister. A cap, comprising a lid base with a sectional protrusion defined by a perforation, may retain a sheet wipe. The cap may include a collar with multiple protrusions on its inner surface, retaining tabs extending from the lid base, and a lid that is integral to the collar and rotatably connected to the lid base. The lid base may include a cylindrical protrusion opposite the collar and retaining tabs, while the lid has first and second cylindrical protrusions. When closed, the lid base protrusion may be disposed between the lid's protrusions, forming a moisture transfer resistant seal. Each protrusion May align with a through-hole, with portions of the sidewall and liner disposed between the retaining tabs, collar, and sidewall surfaces to ensure secure assembly and functionality.

19 Claims, 9 Drawing Sheets

(56) References Cited

U.S. PATENT DOCUMENTS

| | | | | |
|---|---|---|---|---|
| 6,364,101 | B1 * | 4/2002 | Schultz | A47K 10/3818 220/375 |
| 6,474,495 | B1 * | 11/2002 | Frei | B65F 1/06 220/495.08 |
| 7,172,093 | B2 * | 2/2007 | Bando | B65D 83/0805 221/63 |
| 10,214,348 | B2 * | 2/2019 | Andro-Vasko | B65F 1/067 |
| 10,518,942 | B2 * | 12/2019 | Seibert | B65D 43/24 |
| 10,676,271 | B2 * | 6/2020 | Frank | B65D 81/24 |
| 11,142,378 | B1 * | 10/2021 | Laska | B65D 51/20 |
| 2004/0251265 | A1 * | 12/2004 | FitzSimons | A47K 10/3818 221/92 |
| 2005/0205594 | A1 * | 9/2005 | Evans | A47K 10/3818 221/63 |
| 2007/0199949 | A1 * | 8/2007 | Simkins | A47K 10/3818 221/63 |
| 2012/0223178 | A1 * | 9/2012 | Riggs | B65D 75/5883 242/570 |
| 2014/0291343 | A1 * | 10/2014 | Neitzel | A47K 10/3818 221/63 |
| 2014/0367400 | A1 * | 12/2014 | Crudge | A47K 10/38 221/63 |
| 2017/0042395 | A1 * | 2/2017 | Azelton | A47K 10/421 |
| 2018/0354716 | A1 * | 12/2018 | Mandelbaum | B65D 83/0894 |
| 2022/0265097 | A1 * | 8/2022 | Hsu | B65D 1/40 |
| 2022/0315285 | A1 * | 10/2022 | Hunt | B65D 83/08 |
| 2022/0332474 | A1 * | 10/2022 | Cahalan | B65D 43/16 |
| 2025/0009190 | A1 * | 1/2025 | Han | A47K 10/3818 |

* cited by examiner

DETAIL "A"

MOISTURE RETAINING CONTAINER SYSTEMS

CROSS REFERENCE TO RELATED APPLICATIONS

This application claims priority to U.S. Provisional Application No. 63/632,402, filed on Apr. 2024, the entire disclosure of which is hereby incorporated by reference.

BACKGROUND

Plastic is the dominant choice in the current landscape of materials that are available to package and store moist or wet contents in nearly all consumer goods categories. In most cases, the entire container is made from plastic, or plastic is part of a composite layer in a material such as cardboard, adding moisture resistance. The best example of this is a milk carton. However, consumer demand has grown for plastic alternatives or other more sustainable materials. Some of the outcry is from large amount of material that ends up in oceans and rivers and will not break down. And even though plastics such as polypropylene and polyethylene can be recycled dozens of times, there are challenges to collecting and sorting those materials.

Additionally, there is no incentive to collect various containers unless processors can maintain purity and quality of the different recycling streams. This is difficult mainly due to the fact that the recycled material is permanently adhered to a nonrecycled material; therefore, both materials end up in the landfill. In the United States, recycling challenges and a desire from the industry to only collect high-quality plastic and sort from a limited group of base polymers for recycling are increasing. Unfortunately, if high-quality plastic cannot be sorted quickly or with existing equipment, most of the stream of collected recyclables will end up in landfills.

Traditional container systems for storing and dispensing sheet wipes have typically involved simple cylindrical canisters with a removable lid. These canisters often lack features that facilitate the secure retention and easy dispensing of wipes. The lids are generally designed to snap on or screw onto the canister, providing a basic seal to prevent the wipes from drying out. However, these designs often do not adequately address the need for a secure and convenient dispensing mechanism, leading to issues such as multiple wipes being dispensed at once or the wipes drying out due to an imperfect seal.

SUMMARY

This Summary is intended to introduce, in an abbreviated form, various topics to be elaborated upon below in the Detailed Description. This Summary is not intended to identify key or essential aspects of the claimed invention. This Summary is similarly not intended for use as an aid in determining the scope of the claims.

In some aspects, the techniques described herein relate to a container system, including: a cylindrical canister including a base and a sidewall defined by a plurality of through-holes; a liner removably disposed within the canister; a cap including a lid base including a sectional protrusion defined by a perforation configured to retain a sheet wipe by application of a retaining force on the sheet wipe, a collar extending from the lid base, the collar having a plurality of protrusions about an inner surface of the collar, a plurality of retaining tabs extending from the lid base, and a lid integral to the collar and rotatably connected to the lid base, wherein the lid base includes a lid base cylindrical protrusion extending opposite the collar and the plurality of retaining tabs, the lid includes a first lid cylindrical protrusion and a second lid cylindrical protrusion such that when the lid is in a closed position, the lid base cylindrical protrusion is disposed between the first lid cylindrical protrusion and the second lid cylindrical protrusion; wherein each protrusion is disposed within a through-hole, a portion of the sidewall is partially disposed between the plurality of retaining tabs and the collar, the liner is partially disposed between an inner surface of the sidewall and the retaining tabs, and the liner is partially disposed between an outer surface of the sidewall and the collar.

In some aspects, the techniques described herein relate to a system, further including a sheet wipe roll disposed within the canister.

In some aspects, the techniques described herein relate to a system, wherein the liner includes a polymer.

In some aspects, the techniques described herein relate to a system, wherein the liner includes a biodegradable material.

In some aspects, the techniques described herein relate to a system, wherein the cap includes a translucent material.

In some aspects, the techniques described herein relate to a container system, including: a canister including a base and a sidewall defined by a plurality of through-holes; a liner removably disposed within the canister; a cap including a lid base, a collar extending from the lid base, the collar having a plurality of protrusions about an inner surface of the collar, a plurality of retaining tabs extending from the lid base, and a lid rotatably connected to the lid base; wherein each protrusion is disposed within a through-hole, a portion of the sidewall is partially disposed between the plurality of retaining tabs and the collar, and the liner is partially disposed between an inner surface of the sidewall and the retaining tabs.

In some aspects, the techniques described herein relate to a system, wherein the lid base further includes a sectional protrusion defined by a perforation configured to retain a sheet wipe by application of a retaining force on the sheet wipe.

In some aspects, the techniques described herein relate to a system, further including a sheet wipe roll disposed within the canister.

In some aspects, the techniques described herein relate to a system, wherein the lid is integral to the lid base.

In some aspects, the techniques described herein relate to a system, wherein the liner is partially disposed between an outer surface of the sidewall and the collar In some aspects, the techniques described herein relate to a system, wherein the lid base includes a lid base cylindrical protrusion extending opposite the collar and the plurality of retaining tabs, the lid includes a first lid cylindrical protrusion and a second lid cylindrical protrusion such that when the lid is in a closed position, the lid base cylindrical protrusion is disposed between the first lid cylindrical protrusion and the second lid cylindrical protrusion.

In some aspects, the techniques described herein relate to a system, wherein the liner includes a polymer.

In some aspects, the techniques described herein relate to a system, wherein the cap includes a translucent material.

In some aspects, the techniques described herein relate to a system, wherein the canister is cylindrical.

In some aspects, the techniques described herein relate to a system, wherein the canister is prismatic.

In some aspects, the techniques described herein relate to a system, wherein the canister includes a paper-based material.

In some aspects, the techniques described herein relate to a system, wherein the canister includes a biodegradable material.

In some aspects, the techniques described herein relate to a system, wherein each protrusion is tapered.

In some aspects, the techniques described herein relate to a method of disposal of a container system, including: providing the container system, including: a canister including a base and a sidewall defined by a plurality of through-holes; a liner removably disposed within the canister; a cap including a lid base, a collar extending from the lid base, the collar having a plurality of protrusions about an inner surface of the collar, a plurality of retaining tabs extending from the lid base, and a lid rotatably connected to the lid base; wherein each protrusion is disposed within a through-hole, a portion of the sidewall is partially disposed between the plurality of retaining tabs and the collar, and the liner is partially disposed between an inner surface of the sidewall and the retaining tabs; applying force to the sidewall such that the cap detaches from the canister.

BRIEF DESCRIPTION OF THE FIGURES

For a fuller understanding of the nature and objects of the disclosure, reference should be made to the following detailed description taken in conjunction with the accompanying drawings, in which.

DETAILED DESCRIPTION

Implementations disclosed herein solve the problems of non-recyclability of pre-moistened sheet wipe packaging and moisture transfer into and out of pre-moistened sheet wipe packaging.

Implementations disclosed herein include moisture retaining consumer packaging systems. Such systems may be used to package consumer products and goods (CPG) using paper and other materials to retain moisture and protect the product while maintaining full recyclability of the components when disposed of.

Packaging of consumer products involves protection during shipping, storage, retail or online sales. Additionally, packaging may enable dispensing of the product and resealing. CPG packaging is cost-driven in that the cost of the packaging may be minimized. If the product is moist, the packaging must resist the transfer of moisture into and out of the packaging.

One consumer product that is highly dependent upon resistance to the transfer of moisture is pre-moistened sheet wipes, occasionally referred to as towelettes. Conventional packaging for such pre-moistened sheet wipes comprise plastics, glass, or aluminum to reduce the rate at which moisture evaporates from within the packaging. However, each has challenges regarding cost, durability, and recyclability.

Corrugated paper is among materials having the highest recyclability in the United States. Plastics are also recyclable to an extent, but recyclability is highly-dependent on the type of plastic sought to be recycled.

Notwithstanding the recyclability of these base materials, packaging comprising them have very low recycling rates. This is because conventional package designs frequently rely on the bonding of two or more base materials together. For example, a corrugated paper container may have bonded thereto a plastic coating to function as a moisture barrier. In this example, the packaging cannot be recycled at scale because of an inability of recycling centers to efficiently separate the bonded materials. The packaging ends up in the landfill.

Implementations herein combine different materials in single-use packaging in a manner to enhance post-consumer recycling and processing of the raw materials used. Implementations enable separation of a recyclable lid (e.g., a polymer lid), a liner (e.g., a polymer film), and paper-based canister in such a way that these components can be effectively separated or sorted either before or after entering the recycling stream.

Figure 1A:
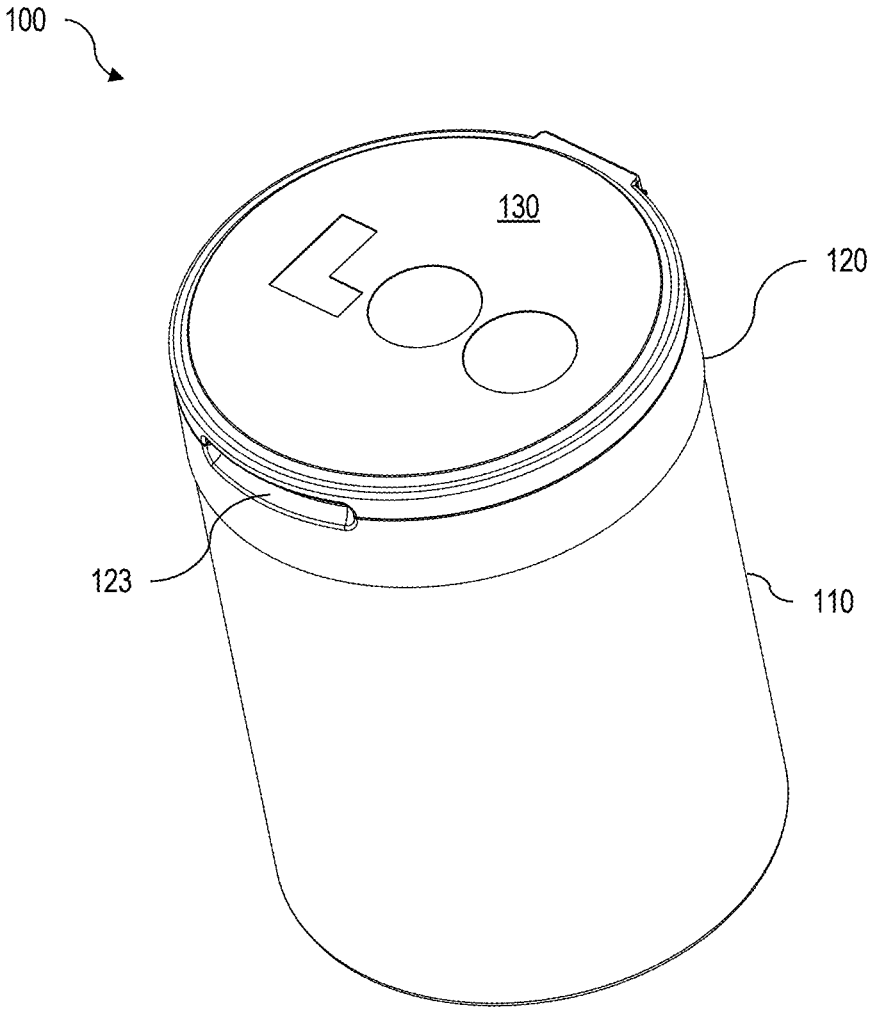
FIG. 1A illustrates a container system, according to one or more implementations herein.

FIG. 1A illustrates a container system 100, according to one or more implementations herein. The container system 100 may be configured to contain a CPG, such as a pre-moistened sheet wipe, while limiting the transfer of moisture into or out of the container system 100.

The container system 100 may include a canister 110 and a cap 120. The cap 120 is illustrated here as installed to the canister 110. The cap 120 may include a lid 130, which may be attached thereto. In some implementations, the lid 130 may be integral to the cap 120 (e.g., cast from a single tool). The cap 120 and the lid 130 may be defined by a depression 123, which may be formed by one or more of the cap 120 and the lid 130. The depression 123 may enable a user to more efficiently apply an opening force to the lid 130 of the cap 120 to open the lid 130.

Figure 1B:
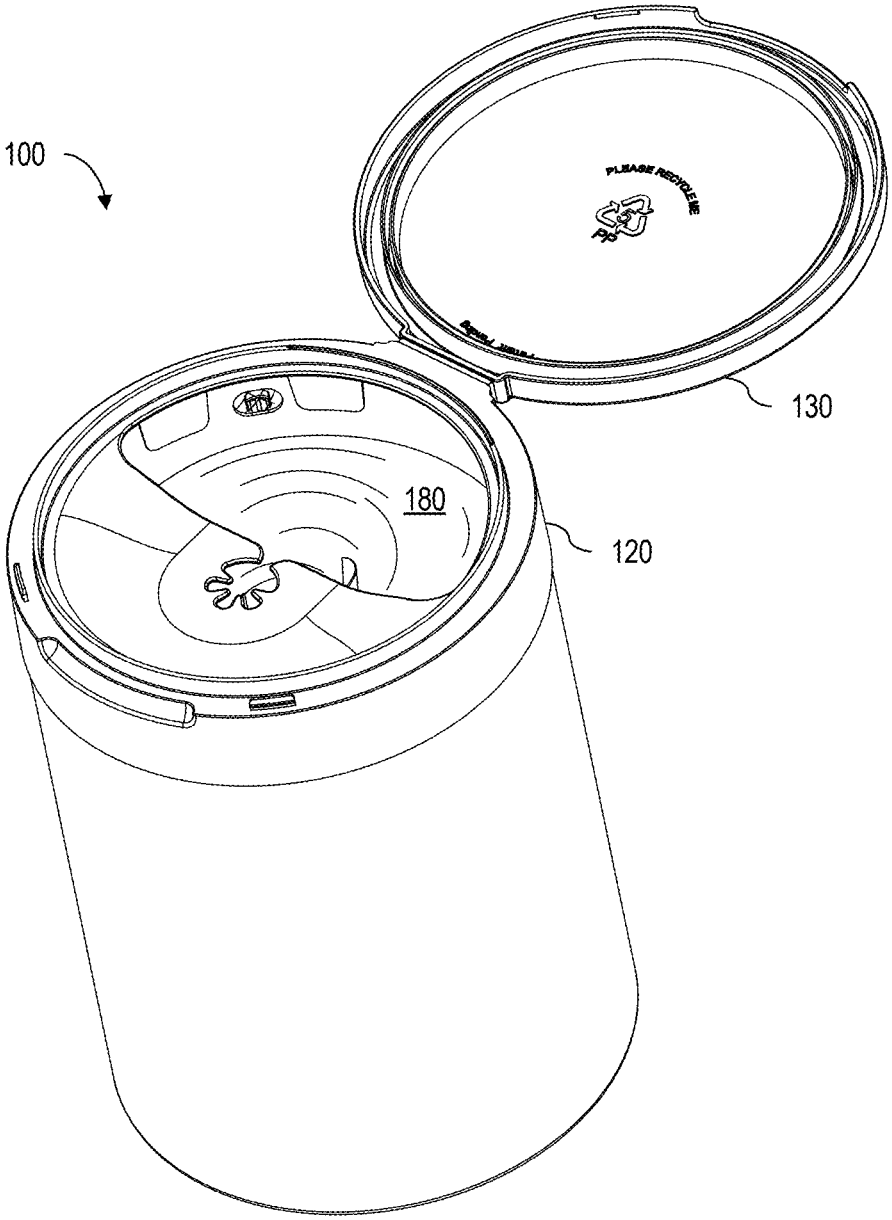
FIG. 1B illustrates the container system having the lid opened, according to one or more implementations herein.

FIG. 1B illustrates the container system 100 having the lid 130 opened, according to one or more implementations herein. When the lid 130 of the container system 100 is opened, a user may be able to access the contents of the container system 100, for example, a sheet wipe roll 180. The sheet wipe roll 180 may comprise one or more sheet wipes (e.g., a perforated roll of wipes or a plurality of separated wipes rolled together). The sheet wipes may be pre-moistened and thus the container system 100 may serve to retain moisture of the sheet wipes. In other implementations, the sheet wipes may be dry, and thus the container system 100 may serve to maintain dryness of the sheet wipes.

Figure 1C:
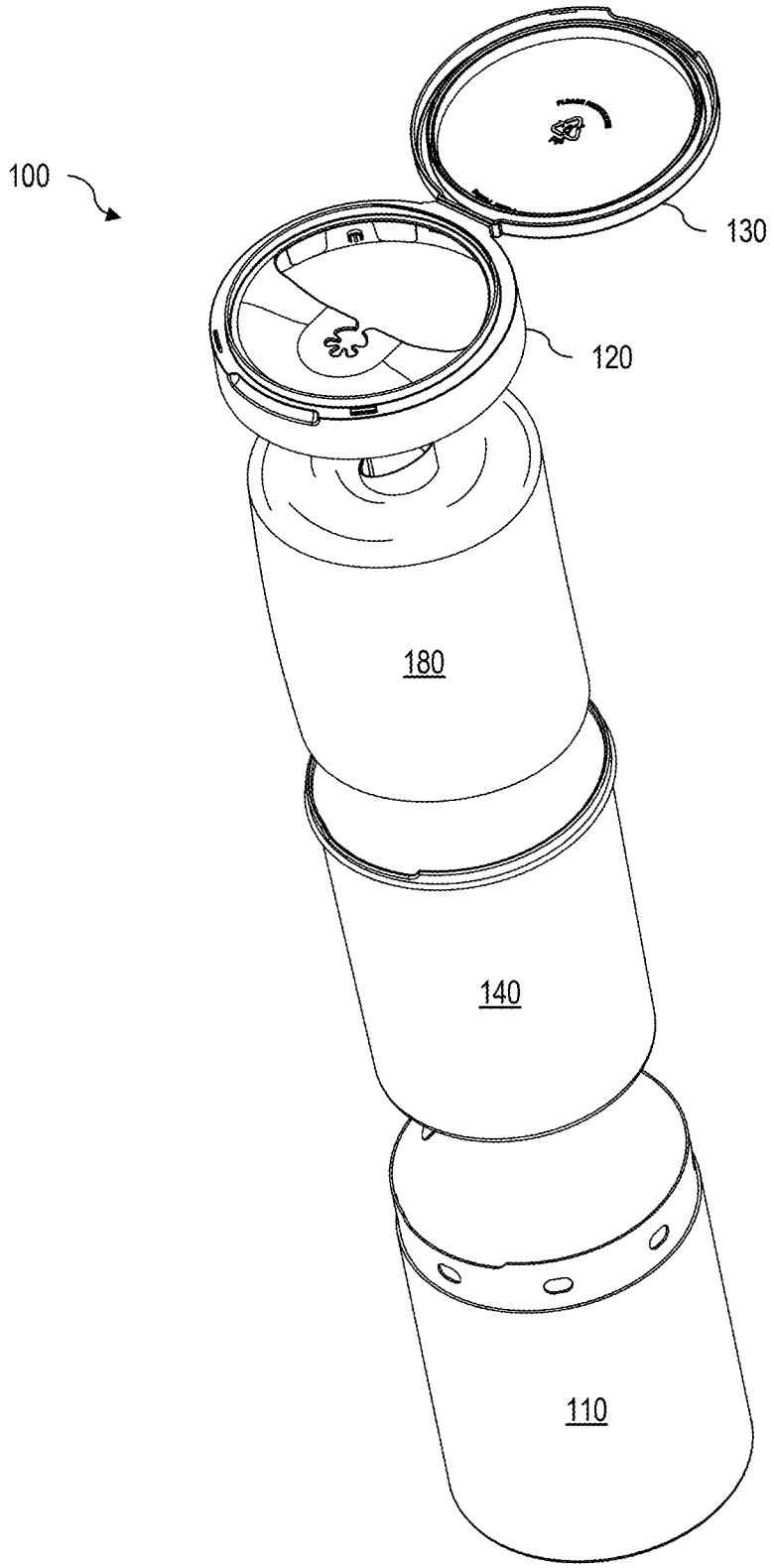
FIG. 1C illustrates an exploded view of a container system, according to one or more implementations herein.

FIG. 1C illustrates an exploded view of a container system 100, according to one or more implementations herein. This view may illustrate the placement, order, and fit of the various components of the container system 100. For example, the container system 100 may include the cap 120 having the lid 130, which may be configured to attach to the canister 110 and contain a liner 140, which may in turn be configured to contain the sheet wipe roll 180.

Figure 2:
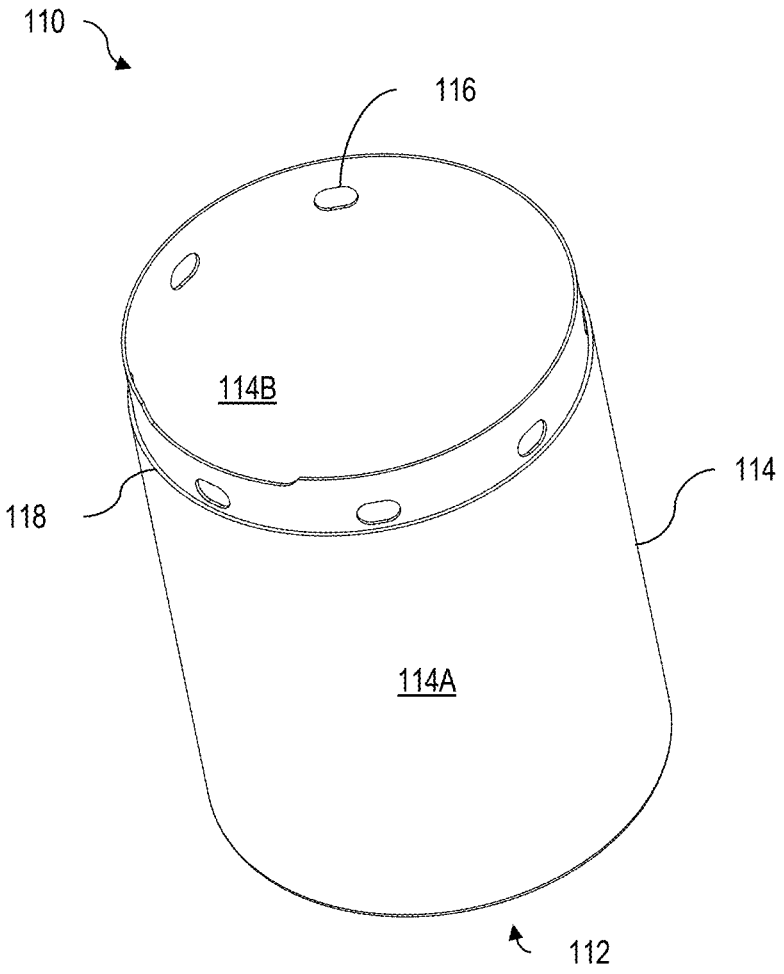
FIG. 2 illustrates the canister, according to one or more implementations herein.

FIG. 2 illustrates the canister 110, according to one or more implementations herein. The canister 110 may provide for containment of a CPG and other aspects used for protecting the CPG, for example, a liner. The canister 110 may be constructed of a paper-based material, for example, corrugated paper or cardboard. Alternatively, the canister 110 may be constructed of a polymer.

The canister 110 may include a base 112. The base 112 may be suitable for supporting and balancing the canister 110 in a position where the base 112 is disposed against a surface supporting the canister 110. The canister 110 may further include a sidewall 114 extending from the base 112. The sidewall 114 may include an outer sidewall surface 114A and an inner sidewall surface 114B. In some implementations, the canister 110 may include a ridge 118, at which the outer sidewall surface 114A steps from an outer circumdiameter at the base 112 to a smaller outer circumdiameter near the top of the canister 110. Such a ridge 118 may provide for a physical limit to the extent a cap may be installed onto the canister 110.

The canister 110 may further include a plurality of through-holes 116. The through-holes 116 may be configured for mechanical attachment of a cap by permitting fit (e.g., a clearance or transition fit) of corresponding protrusions of the cap within the through-holes 116.

While the canister 110 herein is illustrated as cylindrical, it will be understood that the canister 110 may take other geometry. For example, implementations may include a prismatic canister 110. Such prismatic canisters may have, for example, a triangular, square, rectangular, pentagonal, hexagonal, or other polygonal or irregular cross-section.

Figure 3A:
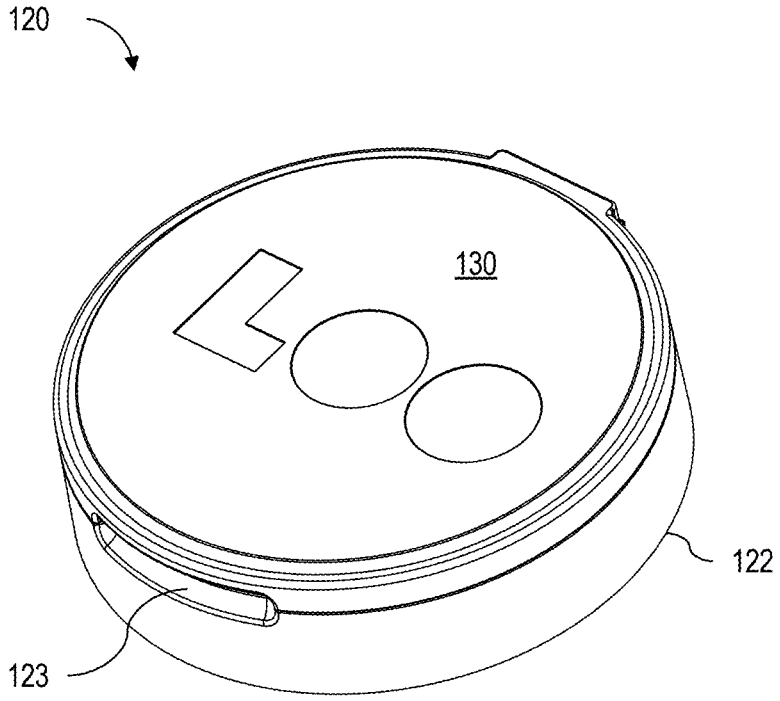
FIG. 3A illustrates the cap in a closed state, according to one or more implementations herein.

FIG. 3A illustrates the cap 120 in a closed state, according to one or more implementations herein. The cap 120 may provide for selective access to the contents of the container system, for example, by opening or closing the lid 130. The cap 120 may be constructed of a variety of materials, including, for example, polymers, wood, or metals (e.g., aluminum). In some implementations, the cap 120 may comprise a translucent material, enabling a user to see the contents of the container system.

The cap 120 may include a collar 122. The collar 122 may be of a shape to fit a canister. For example, where the canister is cylindrical, the collar 122 may be cylindrical. Alternatively, if the canister is prismatic, the collar 122 may be prismatic. The collar 122 may further enable the transition of one cross-section to another, for example, from a hexagonal cross-sectioned canister to a cap 120 configured with a circular lid 130.

The cap 120 and the lid 130 may be further defined by the depression 123, which may be formed by one or more of the cap 120 and the lid 130. The depression 123 may enable a user to more efficiently apply an opening force to the lid 130 of the cap 120 to open the lid 130.

Figure 3B:
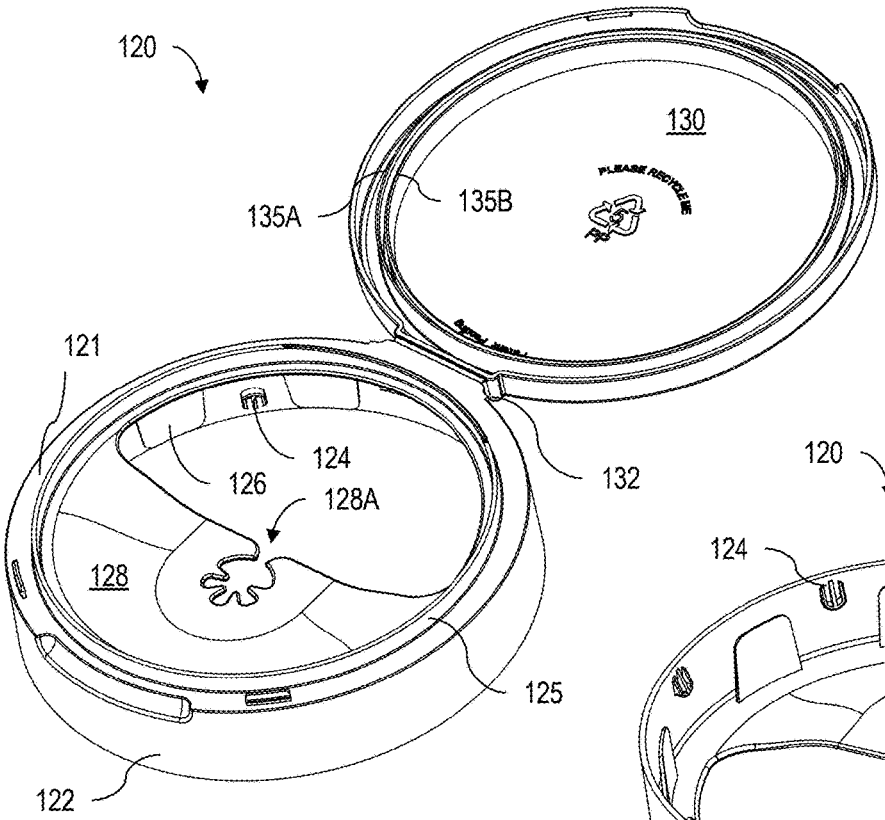
FIG. 3B and FIG. 3C illustrate the cap in an open state, according to one or more implementations herein.
Figure 3C:
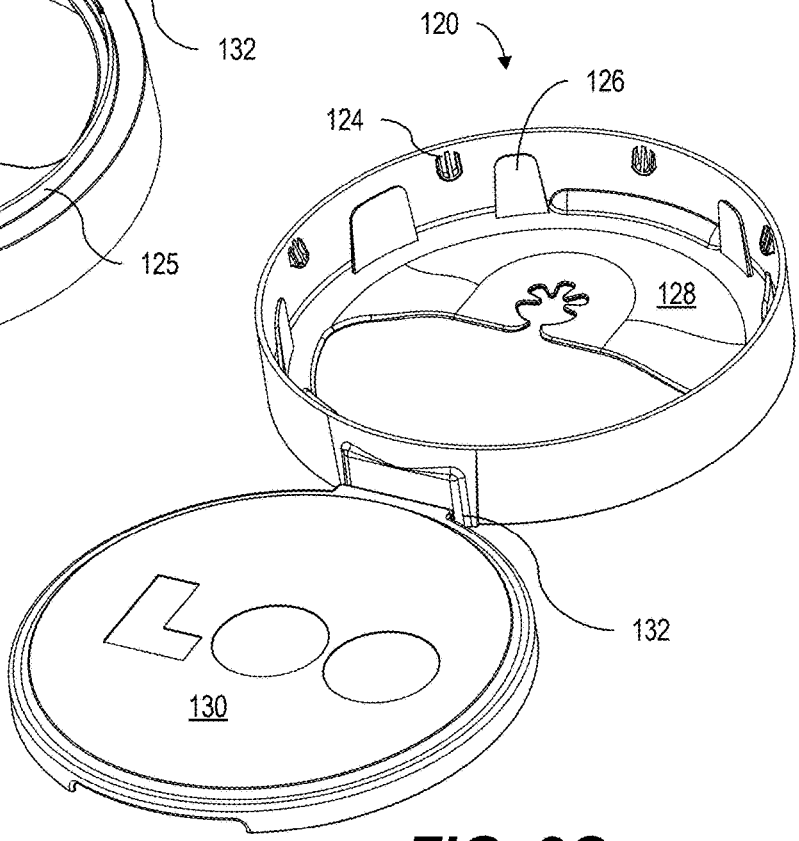

FIG. 3B and FIG. 3C illustrate the cap 120 in an open state, according to one or more implementations herein. In the open state, the cap 120 may permit access of the contents of the container system.

The cap 120 may include a lid base 121. The collar 122 may extend from the lid base 121 such that the collar 122 may be used to retain a portion of a canister to the cap 120. A plurality of tabs 126 may extend from the lid base substantially concentric to the collar 122. The tabs 126 may be sized such that a canister sidewall may be disposable between the inner surface of the collar 122 and the outer surfaces of the tabs 126, thereby retaining a position of the cap 120 relative to the canister.

The collar 122 may include a plurality of protrusions 124 about its inner surface. The protrusions 124 may be configured for disposal within corresponding through-holes of a canister (e.g., the through-holes 116).

Extending from the lid base 121 opposite the collar 122, the tabs 126, and the protrusions 124 may be a lid base cylindrical protrusion 125. Corresponding to the lid base cylindrical protrusion 125 may be a first lid cylindrical protrusion 135A and a second lid cylindrical protrusion 135B extending from the lid 130. When the lid 130 is in a closed state, the lid base cylindrical protrusion 125, the first lid cylindrical protrusion 135A, and the second lid cylindrical protrusion 135B may form a double-walled fit to seal the lid 130 to the cap 120 proximate the lid base 121. In this way, moisture may be retained efficiently when the lid 130 is in a closed state.

The lid 130 may be connected to the lid base 121 by, for example, an attachment 132. The attachment 132 may be a rotatable connection and thereby enable the lid 130 to open away from the lid base 121 and may comprise a hinge or a deformable section of the construction of the cap 120 (for example, a plastic hinge joint).

The lid base 121 may have extending therefrom a sectional protrusion 128 defined by a perforation 128A. The sectional protrusion 128 and the perforation 128A may be configured to retain a sheet wipe by application of a retaining force on the sheet wipe. Such a retaining force may be configured such that a user can pull a sheet wipe through the perforation 128A, but that when not being pulled, a sheet wipe retained at the perforation 128A does not fall back into the canister.

Figure 4A:
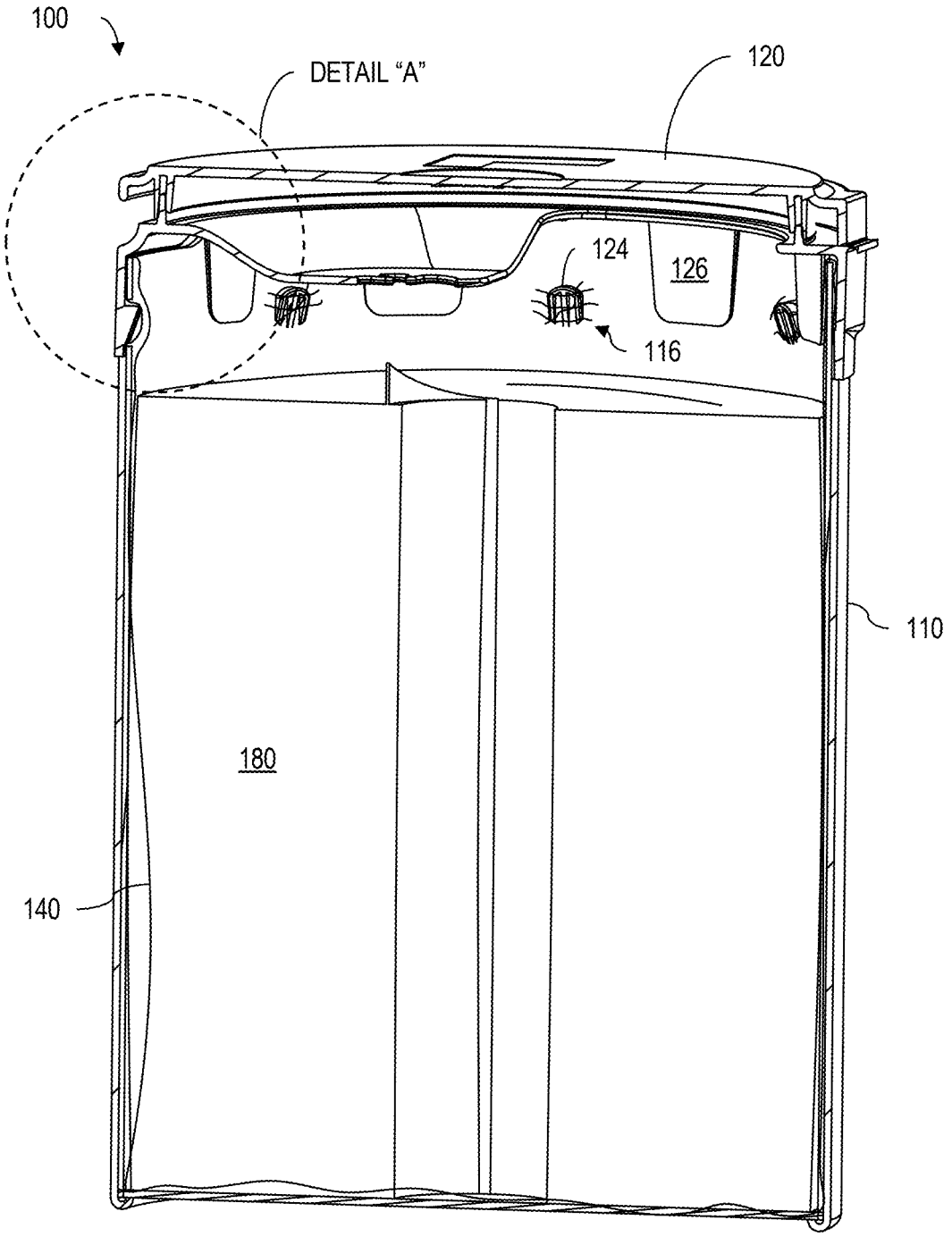
FIG. 4A illustrates a cross-section view of the container system with the sheet wipe roll installed, according to one or more implementations herein.

FIG. 4A illustrates a cross-section view of the container system 100 with the sheet wipe roll 180 installed, according to one or more implementations herein. The container system 100 may include the canister 110, the cap 120 connected to the canister 110 by the protrusions 124 installed within the through-holes 116, and a liner 140 installed within the canister and held in place by at least the tabs 126.

It will be understood that the liner 140 may include a variety of different materials configured to function as a moisture barrier, including, for example, polymers or biodegradable materials.

Figure 4B:
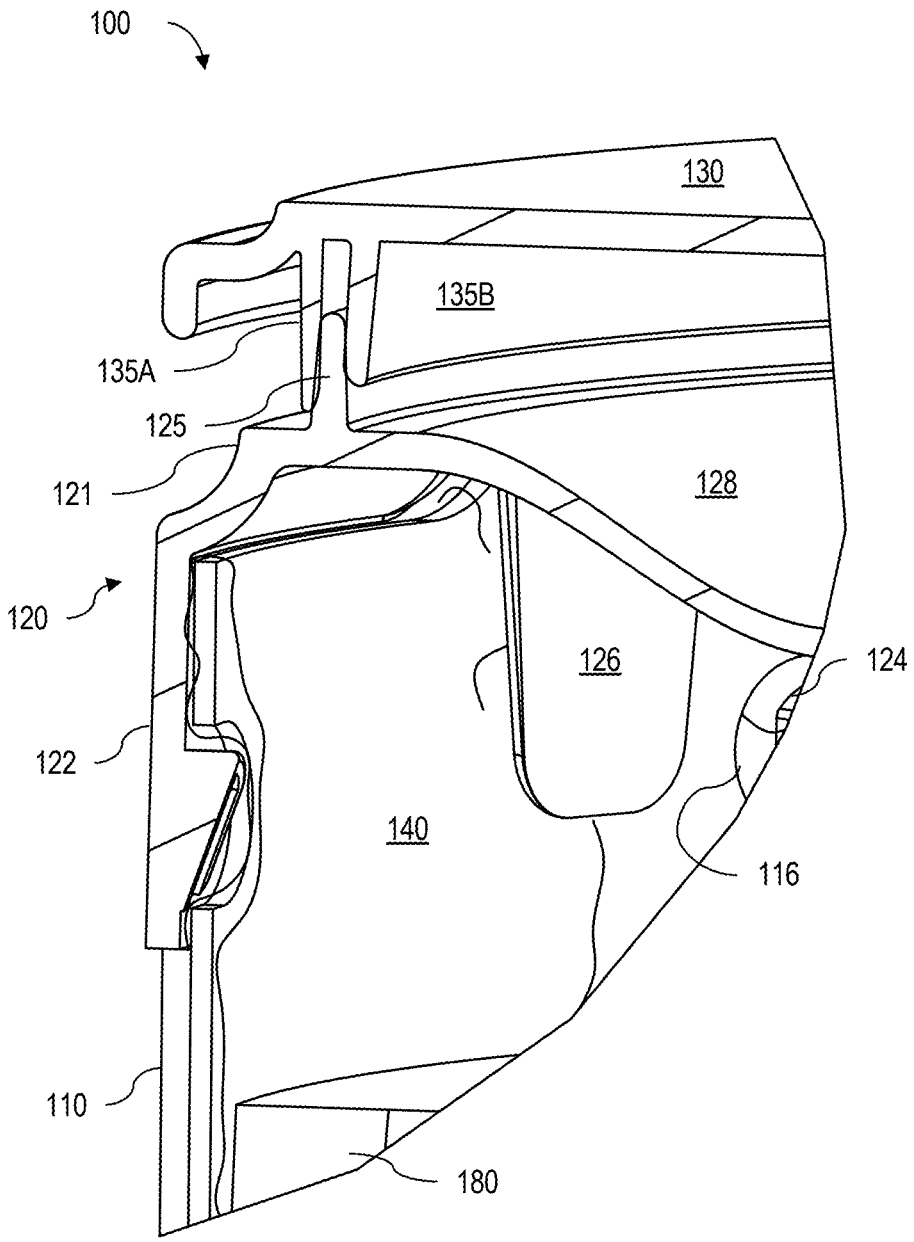
FIG. 4B illustrates a detail vie of the cross-section view of FIG. 4A of the container system, according to one or more implementations herein.

FIG. 4B illustrates a detail view of the cross-section view of FIG. 4A of the container system 100, according to one or more implementations herein. Here, the fit between the lid 130 and the balance of the cap 120 can be observed, that is, the fit of the lid base cylindrical protrusion 125, the first lid cylindrical protrusion 135A, and the second lid cylindrical protrusion 135B may form a double-walled fit to seal the lid 130 to the cap 120 proximate the lid base 121. In this way moisture transfer into or out of the container system 100 is further inhibited.

Furthermore, as illustrated here, in some implementations, the liner 140 may extend over the top edge of the canister 110 such that it is retained both between the tabs 126 and the inner sidewall surface 114B and between the inner surface of the collar 122 and the outer sidewall surface 114A. The tabs 126 may be tapered such that an edge of a tab 126 distal to the lid base 121 is further from the inside wall of the collar 122 than an edge of the tab 126 proximal to the lid base 121. In this way, the cap 120 may be installed to a canister easier.

By utilizing implementations herein, a user may be enabled to retain a moist state of a sheet wipe roll for longer periods of time than conventional sheet wipe roll containers are capable of providing. Furthermore, the ease of detachment of the cap from the canister lends toward improved recyclability of the constituents of the container system, as the base recyclable materials can be separated before or within the recycling stream.

The following figures illustrate example methods and operations thereof. In some implementations, a method illustrated herein may include additional operations, fewer operations, differently arranged operations, or different operations than the operations depicted in the following figures. Moreover, or in the alternative, two or more of the operations depicted in the following figures may be performed at least partially in parallel.

Figure 5:
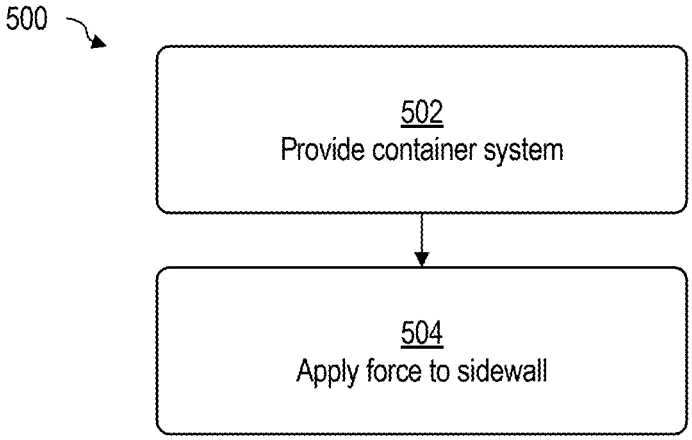
FIG. 5 is a flowchart illustrating an example method, according to one or more implementations herein.

FIG. 5 is a flowchart illustrating an example method 500, according to one or more implementations herein. In some implementations, one or more operations illustrated in FIG. 5 may be performed by one or more of the devices or components depicted in FIG. 1A through FIG. 4B, in concert, in the alternative, or in combinations thereof. In some implementations, one or more operations may be performed by another device, system, or group of devices or systems separate from or including these. Additionally, or alternatively other devices, components, or systems, may be employed to perform the operations.

An operation 502 may include providing a container system and may be performed alone or in combination with one or more other operations depicted in FIG. 5. The container system may include a canister comprising a base and a sidewall defined by a plurality of through-holes. The container system may further include a liner removably disposed within the canister. The container system may further include a cap comprising a lid base, a collar extending from the lid base, the collar having a plurality of protrusions about an inner surface of the collar, a plurality of retaining tabs extending from the lid base, and a lid rotatably connected to the lid base. Each protrusion may be disposed within a through-hole, a portion of the sidewall is partially disposed between the plurality of retaining tabs and the collar, and the liner is partially disposed between an inner surface of the sidewall and the retaining tabs.

An operation 504 may include applying force to a sidewall of the canister of the container system and may be performed alone or in combination with one or more other operations depicted in FIG. 5. For example, an individual need only squeeze the canister for the cap to detach from the canister. Alternatively, the forces applied once the container system enters the recycling stream may effect the same action to cause the cap to detach from the canister. Following separation, shaking, soaking, or other processes typical of recycling processing may cause the liner to release for separation.

The invention is limited only by the appended claims. Variations, characteristics, advantages, implementations, constructions, arrangements, terminology, materials, dimensions, embodiments, illustrations, depictions, and examples composing the above description and accompanying drawings show some possible implementations of the invention without limiting the invention. It is not necessary that every implementation of the invention achieve or possess every advantage, purpose, or characteristic identified herein, and as such, one skilled in the art may effect various additions, changes, modifications, or omissions without departing from the scope or spirit of the invention or its legal equivalents.

All ranges are inclusive of the stated limits, the orders of magnitude thereof, and all values and ranges substantially therebetween unless otherwise defined. Unless otherwise stated, every use of "and" forms an inclusive list comprising at least the conjoined elements, and every use of "or" forms an inclusive list comprising at least one element of conjoined elements. Unless otherwise stated, singular usage (e.g., 'a', 'an', or 'the') includes plurals of the same.

The order of recitations in a claim do not imply a temporal or ordered relationship unless unavoidable by the plain language of that claim. No claim may be interpreted to invoke 35 U.S.C. § 112(f) unless that claim recites "means for" or "step for."

I claim:

1. A container system, comprising:

a cylindrical canister comprising a base and a sidewall defined by a plurality of through-holes;

a liner removably disposed within the cylindrical canister; and a cap comprising a lid base including a sectional protrusion defined by a perforation configured to retain a sheet wipe by application of a retaining force on the sheet wipe, a collar extending from the lid base, the collar having a plurality of protrusions about an inner surface of the collar, a plurality of retaining tabs extending from the lid base, and a lid integral to the collar and rotatably connected to the lid base, wherein the lid base comprises a lid base cylindrical protrusion extending opposite the collar and the plurality of retaining tabs, the lid comprises a first lid cylindrical protrusion and a second lid cylindrical protrusion such that when the lid is in a closed position, the lid base cylindrical protrusion is disposed between the first lid cylindrical protrusion and the second lid cylindrical protrusion;

wherein each protrusion is disposed within one of the plurality of through-holes, a portion of the sidewall is partially disposed between the plurality of retaining tabs and the collar, the liner is partially disposed between an inner sidewall surface of the sidewall and the retaining tabs, and the liner is partially disposed between an outer sidewall surface of the sidewall and the collar.

2. The container system of claim 1, further comprising a sheet wipe roll disposed within the cylindrical canister.

3. The container system of claim 1, wherein the liner comprises a polymer.

4. The container system of claim 1, wherein the liner comprises a biodegradable material.

5. The container system of claim 1, wherein the cap comprises a translucent material.

6. A container system, comprising:

a canister comprising a base and a sidewall defined by a plurality of through-holes;

a liner removably disposed within the canister; and a cap comprising a lid base, a collar extending from the lid base, the collar having a plurality of protrusions about an inner surface of the collar, a plurality of retaining tabs extending from the lid base, and a lid rotatably connected to the lid base;

wherein each protrusion is disposed within one of the plurality of through-holes, a portion of the sidewall is partially disposed between the plurality of retaining tabs and the collar, and the liner is partially disposed between an inner sidewall surface of the sidewall and the retaining tabs.

7. The container system of claim 6, wherein the lid base further comprises a sectional protrusion defined by a perforation configured to retain a sheet wipe by application of a retaining force on the sheet wipe.

8. The container system of claim 6, further comprising a sheet wipe roll disposed within the canister.

9. The container system of claim 6, wherein the lid is integral to the lid base.

10. The container system of claim 6, wherein the liner is partially disposed between an outer sidewall surface of the sidewall and the collar.

11. The container system of claim 6, wherein the lid base comprises a lid base cylindrical protrusion extending opposite the collar and the plurality of retaining tabs, the lid comprises a first lid cylindrical protrusion and a second lid cylindrical protrusion such that when the lid is in a closed position, the lid base cylindrical protrusion is disposed between the first lid cylindrical protrusion and the second lid cylindrical protrusion.

12. The container system of claim 6, wherein the liner comprises a polymer.

13. The container system of claim 6, wherein the cap comprises a translucent material.

14. The container system of claim 6, wherein the canister is cylindrical.

15. The container system of claim 6, wherein the canister is prismatic.

16. The container system of claim 6, wherein the canister comprises a paper-based material.

17. The container system of claim 6, wherein the canister comprises a biodegradable material.

18. The container system of claim 6, wherein each protrusion is tapered.

19. A method of disposal of a container system, comprising:

providing the container system, comprising:

a canister comprising a base and a sidewall defined by a plurality of through-holes;

a liner removably disposed within the canister; and a cap comprising a lid base, a collar extending from the lid base, the collar having a plurality of protrusions about an inner surface of the collar, a plurality of retaining tabs extending from the lid base, and a lid rotatably connected to the lid base;

wherein each protrusion is disposed within one of the plurality of through-holes, a portion of the sidewall is partially disposed between the plurality of retaining tabs and the collar, and the liner is partially disposed between an inner sidewall surface of the sidewall and the retaining tabs; and applying force to the sidewall such that the cap detaches from the canister.

* * * * *